United States Patent [19]

Steinmetz et al.

[11] 3,980,283

[45] Sept. 14, 1976

[54] APPARATUS FOR PERFORMING A CONTINUOUS METALLURGICAL REFINING PROCESS

[75] Inventors: Eberhard Steinmetz; Jürgen Kuhn, both of Bochum, Germany

[73] Assignee: Gesellschaft zur Forderung der Eisenhuttentechnik mbH, Dusseldor, Germany

[22] Filed: Apr. 26, 1974

[21] Appl. No.: 464,714

Related U.S. Application Data

[62] Division of Ser. No. 226,303, Feb. 14, 1972, Pat. No. 3,861,905.

[30] Foreign Application Priority Data

Feb. 16, 1971 Germany ..... 2107263

[52] U.S. Cl. ..... 266/215; 266/218

[51] Int. Cl.[2] ..... C21C 5/56

[58] Field of Search ..... 75/40, 49, 59, 60, 63, 75/93; 266/35, 36 P, 36 H

[56] References Cited

UNITED STATES PATENTS

| | | | |
|---|---|---|---|
| 97,844 | 12/1869 | Wickersham | 266/35 |
| 397,365 | 2/1889 | Ianke | 266/35 |
| 1,680,155 | 8/1928 | Lellep | 266/35 X |
| 1,968,917 | 8/1934 | Soldatoff | 75/60 |
| 3,215,424 | 11/1965 | Kanamori | 75/60 X |
| 3,230,075 | 1/1966 | Nakamura | 75/59 |
| 3,326,671 | 6/1967 | Worner | 75/60 X |
| 3,326,672 | 6/1967 | Worner | 75/93 X |
| 3,432,157 | 3/1969 | Worner | 266/35 |
| 3,542,352 | 11/1970 | Themelis et al. | 266/36 H |
| 3,556,775 | 1/1971 | Kuratomi | 75/60 |
| 3,634,065 | 1/1972 | Worner | 75/60 X |
| 3,761,242 | 9/1973 | Finkl | 75/49 |
| 3,801,304 | 4/1974 | Coets | 75/59 |

FOREIGN PATENTS OR APPLICATIONS

| | | | |
|---|---|---|---|
| 1,433,631 | 4/1964 | Germany | 266/35 |

OTHER PUBLICATIONS

Schenck, H., Steinmetz, E., & Kuhn, J. Material Exchange Between Basic Bessemer Pig Iron and Soda Slag During Desulphurization In An Electromagnetic Counterflow Launder. In Stahl und Eisen 89, No. 22, 1969, pp. 1185–1190.

*Primary Examiner*—Roy Lake
*Assistant Examiner*—Paul A. Bell
*Attorney, Agent, or Firm*—Burgess, Dinklage & Sprung

[57] ABSTRACT

An apparatus for performing a continuous metallurgical refining process in which metal and slag contact one another comprising a counter-current channel in which nozzles are passed through longitudinal side walls of the channel in the region of the predetermined boundary surface between metal and slag, the discharge directions of the nozzles being disposed parallel to or at an inclination to the predetermined boundary surface.

6 Claims, 3 Drawing Figures

APPARATUS FOR PERFORMING A CONTINUOUS METALLURGICAL REFINING PROCESS

Figure 1:
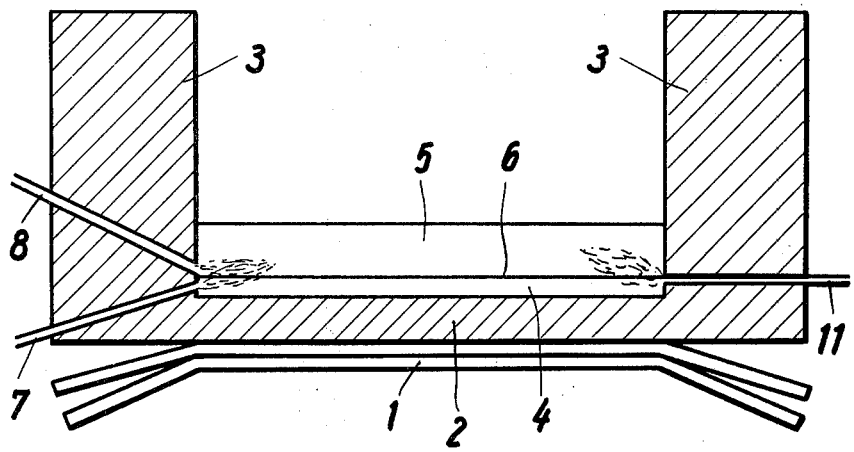

This is a continuation, division, of application Ser. No. 226,303 filed Feb. 14, 1972 now U.S. Pat. No. 3,861,905.

The invention relates to a process for accelerating metallurgical reactions in a counter-current channel, with a stream of metal moved continuously in a counter-current to the slag, and to an apparatus for carrying out the process.

The desired object of continuous processing procedures in metallurgy is a counter-current process, in which the exchange of substance between the phases proceeds in a particularly favourable manner. Since the introduction of the electromagnetic counter-current channel has proved to be particularly advantageous in connection with production processes in the steel industry (Stahl and Eisen, 89, 1969, pages 1185/90), the further improvement in reactions in counter-current channels in accordance with the invention is hereinafter to be explained by reference to the particular example of an electromagnetic counter-current channel.

The counter-current process leads to a better utilisation of the slag and to lower final contents of the undesired impurities in the steel. When using an electromagnetic counter-current channel (German Offenlegungsschrift No. 1,433,831) with an inductor arranged beneath the channel, a layer or bed of thinly liquid metal with a thickness from below 1 cm to about 5 cm is provided in a channel-shaped reaction chamber. The travelling field generated by means of the inductor positively conveys the metal upwardly, while the slag flows downwardly under the action of gravity. It still has to be considered that, in the marginal region of the channel, the electric currents in the liquid metal flow parallel to the longitudinal axis of the channel and thus are unable to produce any forces on the metal in the longitudinal direction. For this reason, under the influence of gravity, there is obtained stoppage or reflux of the metal in this region, depending on the slope of the channel.

The earlier results when using a counter-current channel permitted it to be expected that not all metallurgical reactions proceed as satisfactorily as possible, and that possibly channels with very large dimensions have to be used. This requires a corresponding increase in expenditure and space requirements.

The invention has for its object to contribute to an acceleration of the metallurgical reactions in counter-current channels as hereinbefore defined. It more especially makes possible a shortening of the length of the necessary large installation for a counter-current channel which might otherwise have to be used. It also makes possible a reduction of the proportion of metal which generally flows back when using an electromagnetic counter-current channel.

According to this invention we provide a process for accelerating a metallurgical reaction in which metal and slag are produced, comprising moving a stream of the metal continuously in counter-current to the slag in a countercurrent channel as hereinbefore defined, and for the purpose of forming a metal-slag emulsion injecting at least one jet of a gas having an inert, reducing or oxidising action on the melt depending on the nature of the reaction required into a marginal region of the channel, the said gas being injected parallel to and/or at an inclination to the predetermined boundary surface of the metal and slag or just above and/or just below the said boundary surface.

It is advantageous to inject a gas with an inert action on the melt together with a gas having a reducing or oxidising action on the melt.

It is advantageous to inject the or each gas jet in a pulsating manner and so to control the impulses of the injected gas stream that, on average, a substantially optimum metal droplet size for the reaction is produced. With steel/slag reactions, a mean value of the liquid steel droplets of about 1 to 2 mm is considered as optimal, taking into account the known deviations. The impulse of the gas jet or stream which causes the size of the metal droplets is determined through the pressure - advantageously up to 20 atm - and the cross-section of the gas jet issuing from a supply pipe.

It is to be preferred that, controlled through the amount of the metal-slag emulsion formed, the discharging slag is substantially free from metal droplets, while, following the path of the upwardly flowing metal, the emulsion formation is intensified. It may be appropriate to give the discharging slag, following the counter-current channel, an additional possibility of separation for the metal droplets which are still in the slag.

In another preferred form of the process, two gas jets are so arranged relatively to one another that essentially one gas jet causes a lifting of the slag and the other gas jet causes the droplet formation of the metal flowing therebeneath.

An additional acceleration of the metallurgical reaction can be produced by injecting a gas-forming substance and/or gas-yielding substance, with the gas jet or at least one of the gas jets. These substances can for example vaporise by contact with the metal or the slag or produce gas by reaction therewith. Such a substance injected with the or a gas jet can for example be limestone or a liquid hydrocarbon.

The process according to the invention is advantageously applied to the pre-refining or final refining of melts consisting of pig iron, scrap or similar initial material to from steel.

The use of an electromagnetic counter-current channel is particularly preferred. With this use, it is advantageous if - especially in a return flow region of the metal - at least a part component of the inpulse of the introduced total gas jet quantity acts in a conveying direction of the metal.

An apparatus for carrying out the process according to the invention comprises a counter-current channel as hereinbefore defined in which nozzles are passed through longitudinal side walls of the channel in the region of the predetermined boundary surface between metal and slag, the discharge directions of the nozzles being disposed parallel to or at an inclination to the predetermined boundary surface. In principle, it is preferred for the number of the nozzles to be increased in the direction of the slag supply with the object of an intensified metal/emulsion formation.

With nozzles arranged at an inclination, the angle of inclination towards the predetermined boundary surface is advantageously 30° to 90° to the said boundary surface, especially approximately 45° to the said surface.

Nozzles having an inner diameter from 0.1 to 10 mm are advantageous.

The manner in which the process according to the invention operates may be understood from the following illustrative procedure.

If a section is taken of a counter-current channel perpendicular to a flowing slag and to a flowing metal, there is obtained here, with for instance pig iron or steel, a layer or bed height of approximately 1 to 3 cm with a slag height of 10 to 50 cm. With the known counter-current process, the material transfer can only take place at the phase boundary surface of metal and slag over the width and total length of the channel. According to the invention, for the purpose of forming a metal-slag emulsion, a gas stream is injected into the phase boundary layer. By this means, the specific surface, which is produced from the ratio of metal/slag boundary surface to metal quantity, is raised considerably. By the raising of the specific surface, it is possible for the required metallurgical reaction on the counter-current channel to be produced with considerably smaller geometrical dimensions than with the known processes.

As initially stated, a return flow of metal at the margin of the channel occurs for electrical reasons, whereby a complete change of substance in counter-current is restricted. The gas stream or jet is preferably directed towards a return flow proportion of the metal at a margin of the channel. The impulse of the gas jet may be so chosen that there is formed a size of metal droplet which is the best possible for the reaction on the counter-current channel. A requirement for this purpose is that the droplets are not too small, so that they do not remain an excessively long time in the slag and are not carried downwards by the slag. On the other hand, the drops are not to be too large, so that firstly a sufficiently large specific surface is guaranteed and secondly the drops do not already drop back again into the metal after insufficient reaction with the slag. for steel-slag reactions, a steel droplet diameter of approximately 1 cm is aimed at. The size of droplets can be controlled by means of the impulse of the gas jet, it being known that the droplet size decreases with increasing energy.

From what has been described, it can be inferred that the metal, according to the process of the invention, is conveyed in drop form from the metal stream into the slag stream, where it reacts with the slag and then falls back again into the metal stream. It is to be taken into account here that the metal is conveyed about twenty times as quickly as the downwardly flowing slag, i.e. that with a sufficient residence time of the metal droplet in the downwardly flowing slag stream, the said droplet is only transported downwardly over an insignificant distance. The described cycle of the "jumping metal droplet" is repeated many times along the complete reaction path.

The advantages of the process according to the invention are more particularly shown in the following points:

With a continuous processing procedure on the countercurrent channel, the same result can be produced with considerably smaller channel dimensions;

The heat balance of the procedure as described leads to a more favourable result;

The proportion of metal flowing back at a margin of the channel is reduced.

It is to be pointed out that limits are set for the described emulsification by the service life of the refractory material of the counter-current channel, more especially with a gas jet consisting of substantially pure oxygen. These disadvantages can be avoided or minimised by mixing with a gas inert to the said refractory material.

The invention is hereinafter described by reference to one constructional example.

Figure 2:
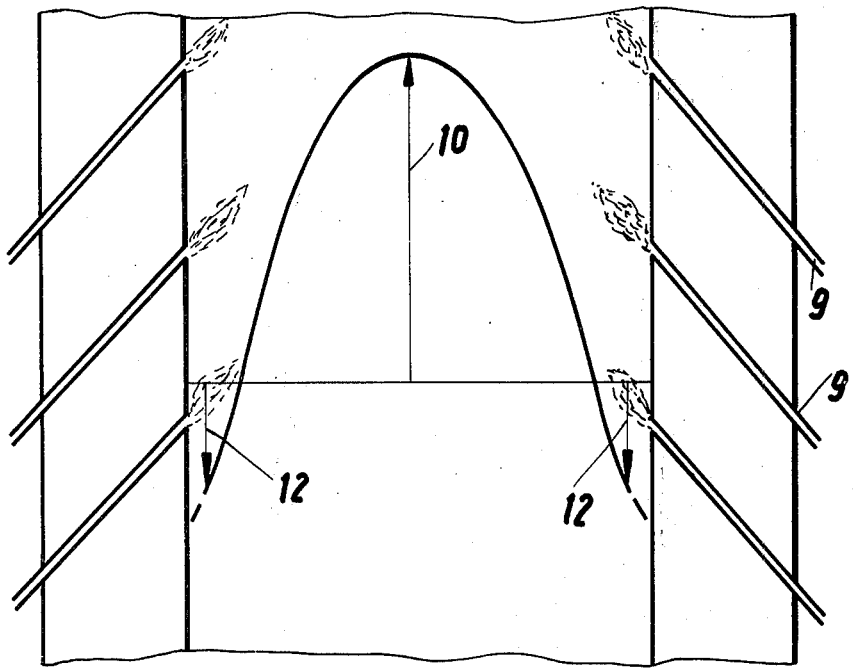

In the accompanying diagrammatic drawings: FIG. 1 is a cross section through an electromagnetic counter-current channel. FIG. 2 is a plan view of a part of the counter-current channel.

Figure 3:
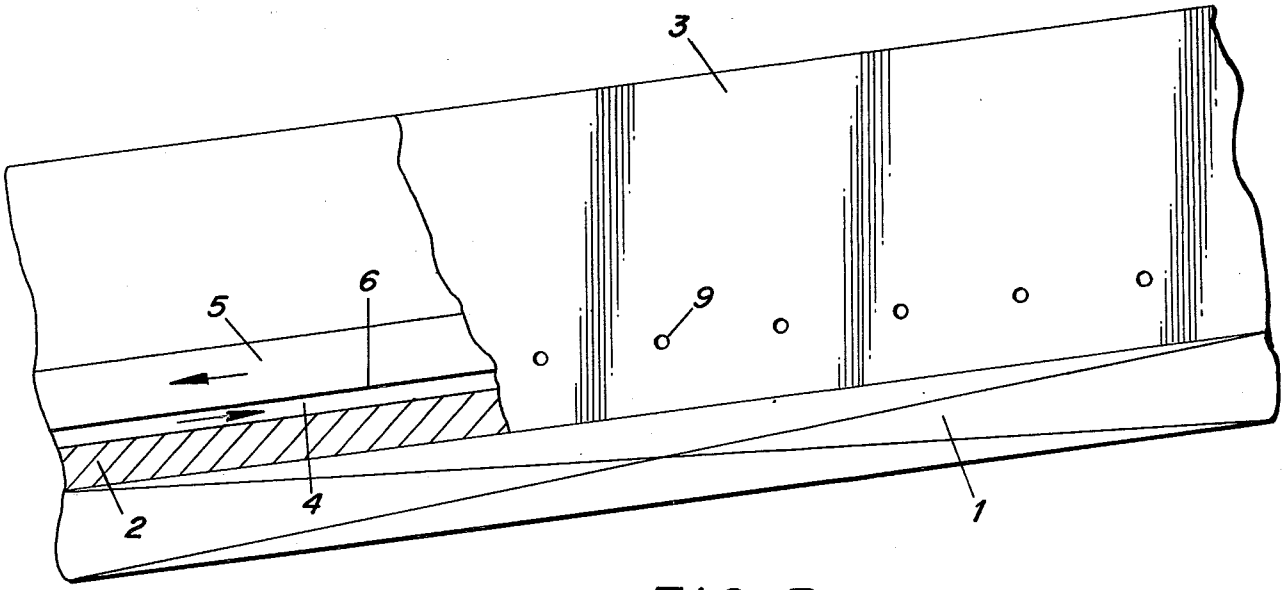

FIG. 3 is a side elevation, partly broken away, showing the electromagnetic counter-current channel of the invention.

An inductor of a travelling field pump is indicated at 1, the refractory base of a reaction chamber of the countercurrent channel is indicated at 2 and the refractory side walls are shown at 3. The specifically heavier metal 4 flows lowermost in the channel and above this is the lighter slag 5. The boundary layer of slag and metal is indicated at 6. By means of nozzles 7,8,11 arranged in the side walls 3, the injection is into the boundary layer 6, or beneath the boundary layer 6, or above the boundary layer 6.

FIG. 2 shows a nozzle arrangement 9 which additionally prevents the return flow of the metal at the margin of the counter-current channel. As shown by the indicated speed profile of the metal stream, the speed vector in the middle region is positively uphill at 10, while thhe speed is directed downwardly at 12 in the marginal region. With the provision of nozzles, which blow substantially into the slag, it is equally well possible to suport the downwardly direction slag flow by an opposite inclined position.

Since the slag should discharge as far as possible free from metal droplets from the channel, an intensified emulsion formation occurs only in the direction towards the metal discharge. This intensified emulsion formation can be regulated by the number of the nozzles.

In one example of use, pig iron drops between 0.1 and 2 mm, advantageously 0.5 to 1.5 mm, were produced with a nozzle of 1 cm inner diameter with a slope of 45° with respect to the stationary metal boundary surface with a pressure of 1 atm, the nozzle being situated about 5 mm below the metal boundary surface.

What we claim is:

1. An apparatus for performing a continuous metallurgical refining process in which metal and slag contact one another counter-currently, comprising an electromagnetic counter-current channel, said electromagnetic counter-current channel inclined upwards with respect to the horizontal, the electromagnet being disposed on said channel to effect upward movement of said metal, said electromagnetic counter-current channel having nozzles for the introduction of refining gases into the immediate vicinity of the metal-slag boundary which nozzles are disposed through the longitudinal side walls of the channel in the region of the predetermined boundary surface between metal and slag, the discharge directions of the nozzles being disposed in the plane of the predetermined boundary surface.

2. An apparatus according to claim 1, wherein the said discharge directions are inclined at an angle of 30° to 90° with respect to the trough centerline in the plane of the predetermined boundary surface.

3. An apparatus according to claim 2, wherein the said angle is approximately 45°.

4. An apparatus according to claim 3, wherein the nozzles have an inner diameter from 0.1 to 10 mm.

5. An apparatus according to claim 1 wherein the nozzles which are positioned in the side walls of the counter-current channel points such that the discharge direction points toward the upper end of said channel.

6. An apparatus for carrying out a metalslag contacting process wherein a layer of slag is disposed over a layer of metal to define a boundary surface, said apparatus being in the form of a longitudinally running channel, said longitudinally running channel being inclined in the longitudinal direction with respect to the horizontal and being fitted with an electromagnetic device which moves said metal upwardly in said channel and counter-current flow to said slag, said apparatus having nozzles for the introduction of refining gases into the immediate vicinity of the metal-slag boundary, which nozzles are disposed through the longitudinal side walls of said channel, said nozzles being in the plane of the predetermined boundary surface and directed toward said boundary surface.

* * * * *